US009691581B2

(12) United States Patent
Faltermeier et al.

(10) Patent No.: US 9,691,581 B2
(45) Date of Patent: Jun. 27, 2017

(54) FUSE ARRANGEMENT

(71) Applicant: Siemens Aktiengesellschaft, Munich (DE)

(72) Inventors: Markus Faltermeier, Regensburg (DE); Robert Huttinger, Schofweg (DE); Thomas Lohr, Sinzing (DE); Adolf Schmid, Laaber (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 425 days.

(21) Appl. No.: 13/763,802

(22) Filed: Feb. 11, 2013

(65) Prior Publication Data

US 2013/0207769 A1 Aug. 15, 2013

(30) Foreign Application Priority Data

Feb. 10, 2012 (DE) ..... 10 2012 202 059

(51) Int. Cl.

| | |
|---|---|
| ***H01H 85/24*** | (2006.01) |
| ***H01H 85/153*** | (2006.01) |
| ***H01H 85/22*** | (2006.01) |
| *H01H 85/12* | (2006.01) |

(52) U.S. Cl.

CPC ..... *H01H 85/24* (2013.01); *H01H 85/153* (2013.01); *H01H 85/22* (2013.01); *H01H 85/12* (2013.01)

(58) Field of Classification Search

CPC ..... H01H 85/24; H01H 85/22; H01H 85/153; H01H 85/12

USPC ..... 337/186, 187, 188, 189, 283, 290; 361/626, 642, 646, 833, 835, 837

See application file for complete search history.

(56) References Cited

U.S. PATENT DOCUMENTS 2,167,608 A * 7/1939 Cole ..... H01R 4/36 174/129 B
3,152,231 A * 10/1964 Edsall ..... 337/284
3,156,801 A * 11/1964 Cole et al. ..... 337/161
(Continued)

FOREIGN PATENT DOCUMENTS

CH 335351 A 12/1958 ..... H01H 85/143
CN 2342464 Y 10/1999 ..... H01H 85/26
(Continued)

OTHER PUBLICATIONS

Chinese Office Action, Application No. 201310050152.8, 15 pages, Oct. 28, 2015.

*Primary Examiner* — Anatoly Vortman
(74) *Attorney, Agent, or Firm* — Slayden Grubert Beard PLLC

(57) ABSTRACT

A fuse arrangement includes a first safety fuse and a second safety fuse connected electrically in parallel with each other. The fuse arrangement also includes an end plate mechanically coupled to the first and second safety fuses to form a structural unit so that both safety fuses must be inserted/removed to/from an electrical power distribution installation at the same time. Furthermore, the electrical parallel connection of the two safety fuses, rather than a single relatively larger safety fuse, may allow the maximum current strength of an electrical power distribution installation to be maintained while the current is split between the two safety fuses so the size of the fuse arrangement may be reduced.

13 Claims, 7 Drawing Sheets

(56) References Cited

U.S. PATENT DOCUMENTS

| | | | | | |
|---|---|---|---|---|---|
| 3,489,978 | A | | 1/1970 | Mikulecky | 337/156 |
| 3,639,873 | A | | 2/1972 | Hodgson | 337/187 |
| 3,810,063 | A | * | 5/1974 | Blewitt | 337/166 |
| 3,838,375 | A | * | 9/1974 | Frind et al. | 337/276 |
| 4,355,269 | A | * | 10/1982 | Burton | H02K 15/125 318/436 |
| 4,691,197 | A | * | 9/1987 | Damiano | H02H 3/046 337/241 |
| 4,906,963 | A | | 3/1990 | Ackermann et al. | 337/244 |
| 5,982,267 | A | * | 11/1999 | Locht | 337/186 |
| 6,304,429 | B1 | * | 10/2001 | Locht et al. | 361/623 |
| 6,459,356 | B1 | * | 10/2002 | Dout et al. | 337/198 |
| 6,476,705 | B1 | * | 11/2002 | Betti et al. | 337/161 |
| 6,509,824 | B2 | * | 1/2003 | Inaba et al. | 337/295 |
| 6,753,754 | B1 | * | 6/2004 | Black et al. | 337/215 |
| 7,378,933 | B2 | * | 5/2008 | Rogers | 337/227 |
| 7,515,031 | B2 | * | 4/2009 | Jakobsen et al. | 337/187 |
| 7,808,362 | B2 | * | 10/2010 | Stanek et al. | 337/187 |
| 1,045,051 | A1 | | 11/2012 | Mallory | 337/234 |
| 2002/0080005 | A1 | * | 6/2002 | Mollet et al. | 337/255 |
| 2003/0085048 | A1 | * | 5/2003 | Lindholm et al. | 174/17 VA |
| 2005/0237147 | A1 | * | 10/2005 | Carreras | 337/186 |
| 2006/0284721 | A1 | | 12/2006 | Jakobsen et al. | 337/187 |
| 2007/0159291 | A1 | | 7/2007 | Wilniewczyc et al. | 337/159 |
| 2011/0148564 | A1 | * | 6/2011 | Staylor | 337/191 |

FOREIGN PATENT DOCUMENTS

| | | | | |
|---|---|---|---|---|
| CN | 1795523 | A | 6/2006 | H01H 85/042 |
| DE | 672563 | C | 3/1939 | H01H 85/143 |
| DE | 295336 | C | 11/2015 | H01H 85/143 |
| GB | 593784 | A | 10/1947 | H01H 85/143 |

* cited by examiner

FUSE ARRANGEMENT

CROSS-REFERENCE TO RELATED APPLICATIONS

This application claims priority to DE Patent Application No. 10 2012 202 059.4 filed Feb. 10, 2012. The contents of which is incorporated herein by reference in its entirety.

TECHNICAL FIELD

The disclosure relates to a fuse arrangement for safety fuses.

BACKGROUND

A safety fuse is an overcurrent protection facility, which interrupts the current circuit by fusing one or more fuse elements, if the current strength exceeds a specific value over a specific period of time. A safety fuse typically consists of an insulated body comprising two electrical connections, which are connected to one another inside the insulating body by way of the fuse element. The fuse element is heated by the current flowing therethrough, and when the nominal current of the fuse is clearly exceeded for a specific period of time, the fuse element melts to open the circuit.

Safety fuses of this type are used inter alia in the field of electrical installations in so-called electrical power distribution installations. Because space is limited in electrical power distribution installations, the electrical line to be fused is divided into several lines which are electrically connected in parallel with one another. The several lines are also fused in each instance with their own safety fuse. Here the maximum current strength across each of the several lines is reduced accordingly depending on the safety fuse of each of the several lines, so that narrower and flatter fuse bodies can be used in the electrical power distribution installation. By dividing the current across several fused lines, compact electrical power distribution installations can be used. Furthermore, the power loss and the $I^2t$ value are reduced by the parallel connection of the safety fuses.

In an electrical power distribution installation having electric lines connected in parallel, problems may arise if individual safety fuses are used therein. For example, problems may arise if the safety fuses can be individually disconnected from an electrical power distribution installation and exchanged for other individual safety fuses. While one may intend to replace a damaged safety fuse, an undamaged safety fuse may accidentally be replaced while the damaged safety fuse remains in the electrical power distribution installation. Furthermore, a safety fuse could be removed from the electrical power distribution installation and accidentally replaced by a safety fuse of a different type (with a correspondingly similar installation size). These possibilities are to be prevented under all circumstances against the background of more stringent procedures to ensure these problems do not occur.

SUMMARY

One embodiment provides a fuse arrangement comprising: a first safety fuse, a second safety fuse, which is arranged adjacent to the first safety fuse and is provided with the first safety fuse for an electrical parallel connection, and an end plate, which is mechanically coupled to the first safety fuse and the second safety fuse, such that a structural unit is herewith formed.

In a further embodiment, the fuse arrangement comprises at least one further safety fuse, which is electrically connected in parallel to the first safety fuse and the second safety fuse and is likewise mechanically coupled to the end plate. In a further embodiment, the safety fuses each comprise a first contact and a second contact respectively.

In a further embodiment, the safety fuses each comprise a first contact and a second contact respectively.

In a further embodiment, the first contacts are arranged twisted about a longitudinal direction of the safety fuses relative to the second contacts.

In a further embodiment, at least one of the contacts comprises an inner thread for electrical contacting purposes.

In a further embodiment, the first contacts and/or the second contacts are embodied as blade contacts.

In a further embodiment, at least one of the blade contacts comprises a borehole for electrical contacting purposes.

In a further embodiment, at least one of the blade contacts is embodied with slots.

In a further embodiment, the first contacts each comprise a first slot which is aligned with a first direction, and the second contacts each comprise a second slot which is aligned along the longitudinal direction, oriented at right angles to the first direction.

BRIEF DESCRIPTION OF THE DRAWINGS

Example embodiments of a fuse arrangement are described in more detail with the aid of the appended figures, in which.

DETAILED DESCRIPTION

Figure 1A:
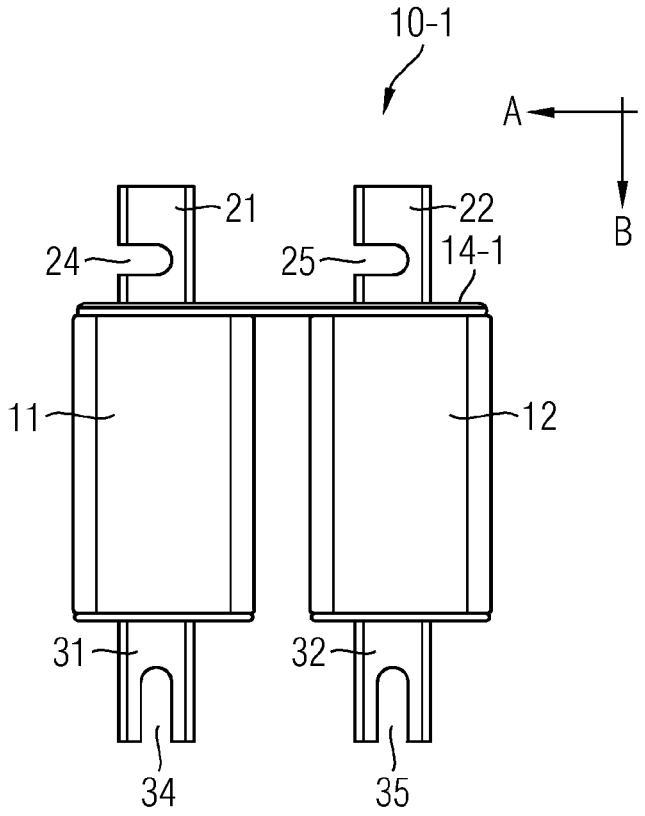
FIGS. 1A to 1D show schematic representations of a first exemplary embodiment of the fuse arrangement.
Figure 1B:
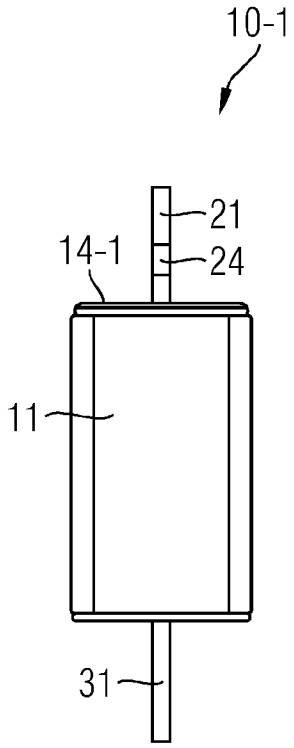
Figure 1C:
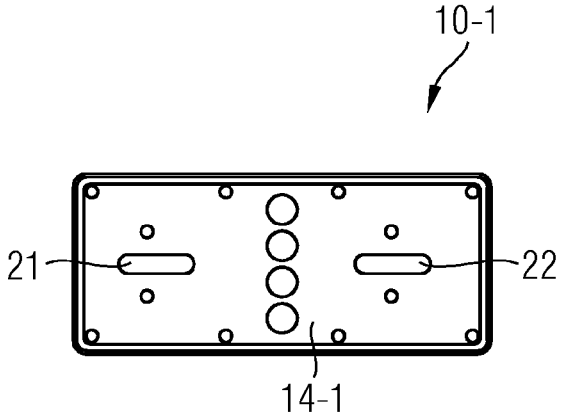
Figure 1D:
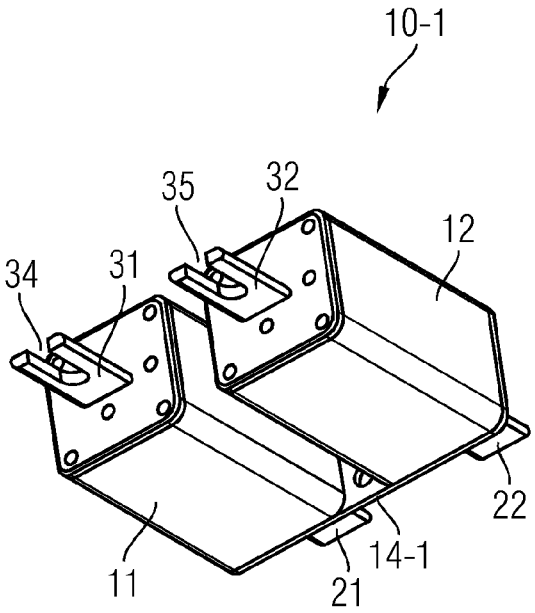
Figure 2A:
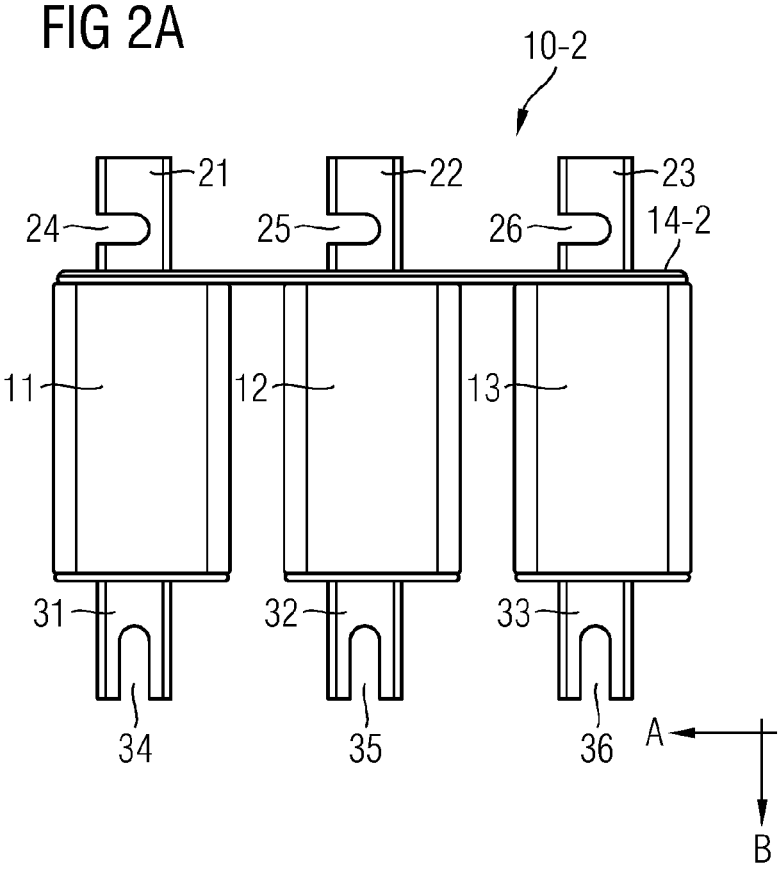
FIGS. 2A to 2D show schematic representations of a second exemplary embodiment of the fuse arrangement.
Figure 2B:
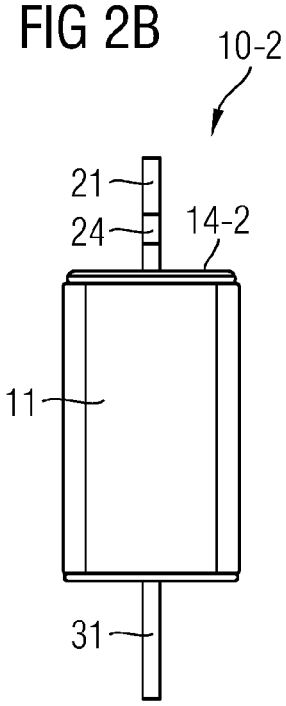
Figure 2C:
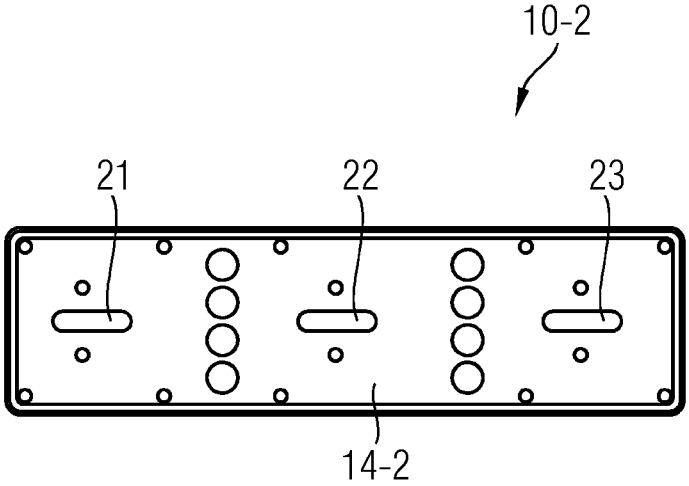
Figure 2D:
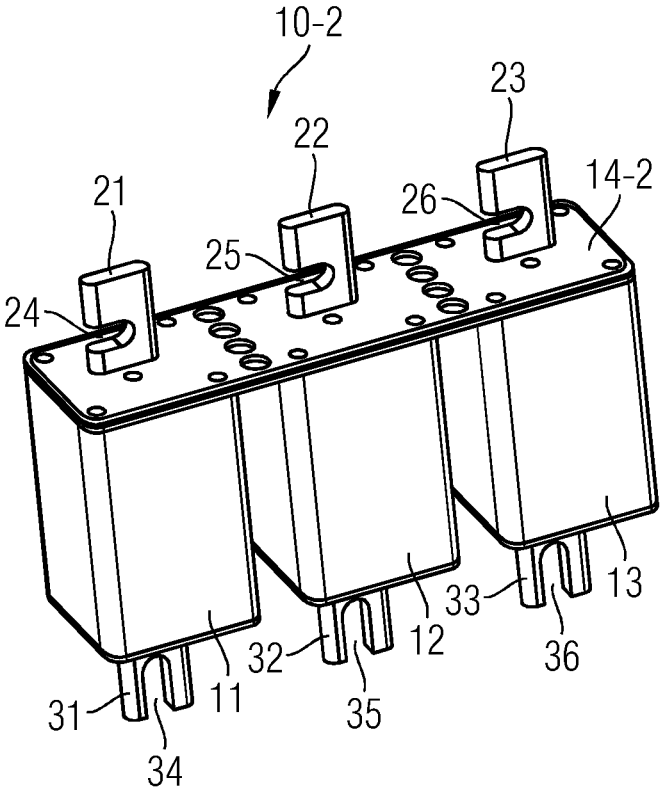

Embodiments disclosed herein provide a fuse arrangement, which may overcome certain problems discussed above regarding conventional fuse arrangement.

In one embodiment, a fuse arrangement comprises a first safety fuse and a second safety fuse, which is arranged adjacent to the first safety fuse and is provided to form an electrical parallel connection with the first safety fuse. Furthermore, the fuse arrangement comprises an end plate, which is mechanically coupled to the first safety fuse and the second safety fuse such that a structural unit is herewith formed.

The first safety fuse and the second safety fuse are permanently connected to the end plate so that neither of the two safety fuses can be disconnected from the assembly of the fuse arrangement without the assistance of a tool. Alternatively, the safety fuses are undetachably connected to the end plate, so that one of the safety fuses may only be detached from the assembly by destruction of said safety fuse and/or the end plate. A simple disassembly and thus replacement of only one of the two safety fuses is therefore no longer possible. Because the first safety fuse and the second safety fuse now form a structural unit of two safety fuses connected electrically in parallel with one another, assembly and/or disassembly of individual safety fuses is precluded. The parallel connection of several safety fuses can use narrower and flatter safety bodies, because the maximum current strength of the individual safety fuses, which are electrically connected in parallel, is reduced accordingly. The installation space required for the arrangement can therefore be kept correspondingly more compact than would be the case with a single safety fuse having a corresponding maximum current strength of three times more.

The electrical parallel connection of the first safety fuse and the second safety fuse can take place by way of the end plate, which may be conductive. Alternatively however, a non-conductive end plate can also be used, for instance made of plastic, wherein in this case the electrical parallel connection of the first and second safety fuse takes place by way of the electrical connections and/or contacts of the safety fuses.

In one embodiment, the fuse arrangement comprises at least one further safety fuse, which is electrically connected in parallel to the first safety fuse and the second safety fuse and is likewise mechanically coupled to the end plate. With the aid of a correspondingly embodied end plate, depending on the application, three or more safety fuses can also be connected to the end plate without any large structural outlay and thus combined to form a structural unit. The structural unit may then be assembled and disassembled relative to an electrical power distribution installation such that a disconnection of an individual safety fuse from the electrical power distribution installation is no longer possible.

In a further embodiment of the fuse arrangement, the safety fuses comprise in each instance a first contact and in each instance a second contact. The first contacts and second contacts are guided out of the safety body of the respective safety fuse and are used to electrically contact the respective safety fuse.

In a further embodiment of the fuse arrangement, the first contacts are arranged twisted about a longitudinal direction of the safety fuses relative to the second contacts. Each first contact may be at 45° or 90° about the longitudinal direction relative to the second contact of the relevant safety fuse. The fuse arrangement can in this way be flexibly adjusted to the most varied of operating conditions.

In a further embodiment of the fuse arrangement, at least one of the contacts comprises an inner thread for electrical contacting purposes. With the aid of the inner thread, which may be embodied as a metric ISO thread, the fuse can also be electrically connected by means of a corresponding screw connection, for instance of the M10 or M12 type.

In a further embodiment of the fuse arrangement, the first contacts and/or the second contacts are embodied as blade contacts. Blade contacts are also referred to as contact blades and are embodied in a correspondingly compact manner in order to conduct higher currents.

In a further embodiment of the fuse arrangement, at least one of the blade contacts comprises a borehole for electrical contacting purposes.

In a further embodiment of the fuse arrangement, at least one of the blade contacts is embodied with slots. Slotted blade contacts enable a quick and simple fastening and contacting of the fuse arrangement, for instance on a busbar.

In a further embodiment of the fuse arrangement, the first contacts each comprise a first slot, which is aligned with a first direction. The second contacts each comprise a second slot, which is aligned along the longitudinal direction, oriented at right angles to the first direction. By the first slots being aligned in the first direction and the second slots in the second direction, which is oriented at right angles, e.g., perpendicular, to the first direction, a compensatory tolerance is realized, i.e. a possibility of compensating for manufacturing tolerances relating to the dimensions of the individual safety fuses. A higher flexibility in respect of adjustment to different operating conditions of the fuse arrangement is achieved in this way by the varied alignment of the slots.

FIGS. 1A to 1D show schematic representations of a first exemplary embodiment of a fuse arrangement 10-1 in several views. A first safety fuse 11 and a second safety fuse 12 are combined to form a structural unit with the aid of an end plate 14-1. The two safety fuses 11 and 12 comprise a square safety body and are mechanically permanently connected to the end plate 14-1. The first safety fuse 11 comprises a first contact 21 and a second contact 31. Similarly, the second safety fuse 12 comprises a first contact 22 and a second contact 32. The first contacts 21 and 22 are passed here through a correspondingly embodied opening in the end plate 14-1. In order to realize a fixed connection of the end plate 14-1 with the first safety fuse 11 and the second safety fuse 12, these can be glued to the end plate 14-1 for instance.

Figure 5:
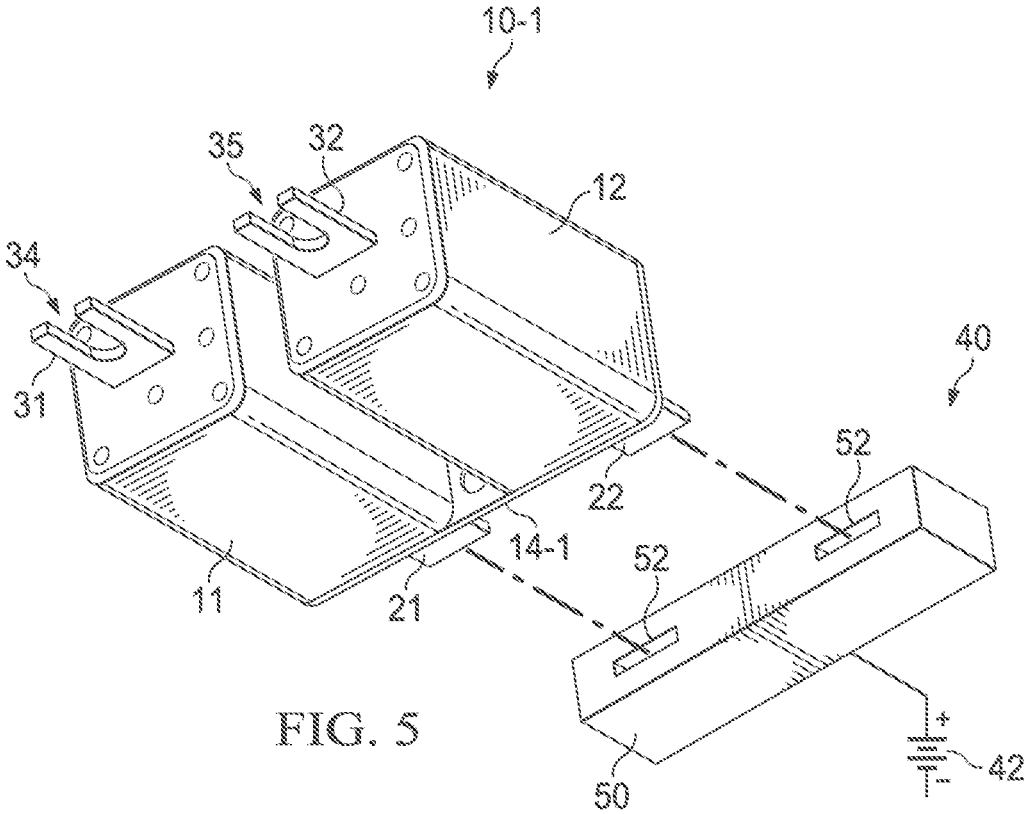
FIG. 5 shows an example circuit including a busbar to which fuse arrangement as disclosed herein may be connected.

The first contacts 21 and 22 are embodied as slotted blade contacts and to this end comprise in each instance a first slot 24 and/or 25, which is aligned respectively with a first direction A. Similarly, the second contacts 31 and 32 are embodied as slotted blade contacts and each comprise a second slot 34 and/or 35, which is aligned in each instance with a second direction B, which is oriented essentially at right angles to the first direction A. On account of the different, essentially perpendicular alignment of the first slots 24 and 25 relative to the second slots 34 and 35, a compensatory tolerance, i.e. possibility of compensating for manufacturing specific dimensional tolerances of the individual safety fuses, is enabled. The use of slotted blade contacts 21, 22, 31 and 32 further makes it possible to fasten and connect the fuse arrangement 10-1 rapidly and simply, for instance to corresponding connection structures, e.g., blade receptacles, of a conventional busbar, e.g., as shown in FIG. 5.

FIGS. 2A to 2D show schematic representations of a second exemplary embodiment of the fuse arrangement 10-2 in several views. Contrary to the first exemplary embodiment shown in FIGS. 1A to 1D, aside from the first safety fuse 11 and the second safety fuse 12, a further safety fuse 13 is mechanically coupled here to a suitable end plate 14-2, i.e. to the end plate 14-2. The further safety fuse 13 is identical in construction to the first safety fuse 11 and/or the second safety fuse 12 and comprises a first contact 23 with a first slot 26 and a second contact 33 with a second slot 36. The end plate 14-2 corresponds here essentially to the end plate 14-1 shown in the first exemplary embodiment, with the difference that the end plate 14-2 is embodied for the mechanical coupling of three safety fuses 11, 12 and 13 and to this end comprises a further opening, through which the first contact 23 of the further safety fuse 13 is passed.

With this embodiment, three essentially structurally identical safety fuses 11, 12 and 13 are electrically connected in parallel to one another, so that the electric current splits into the three safety fuses 11, 12 and 13. The maximum current strength of this fuse arrangement 10-2 thus corresponds to three times the maximum current strength of the individual, structurally identical safety fuses 11, 12 and 13. The individual safety fuses 11, 12 and 13 can in this way be embodied to be narrower and flatter so that the installation space required for this fuse arrangement 10-2 can be kept correspondingly more compact than would be the case with a single safety fuse having a maximum current strength of correspondingly three times more.

Figure 3A:
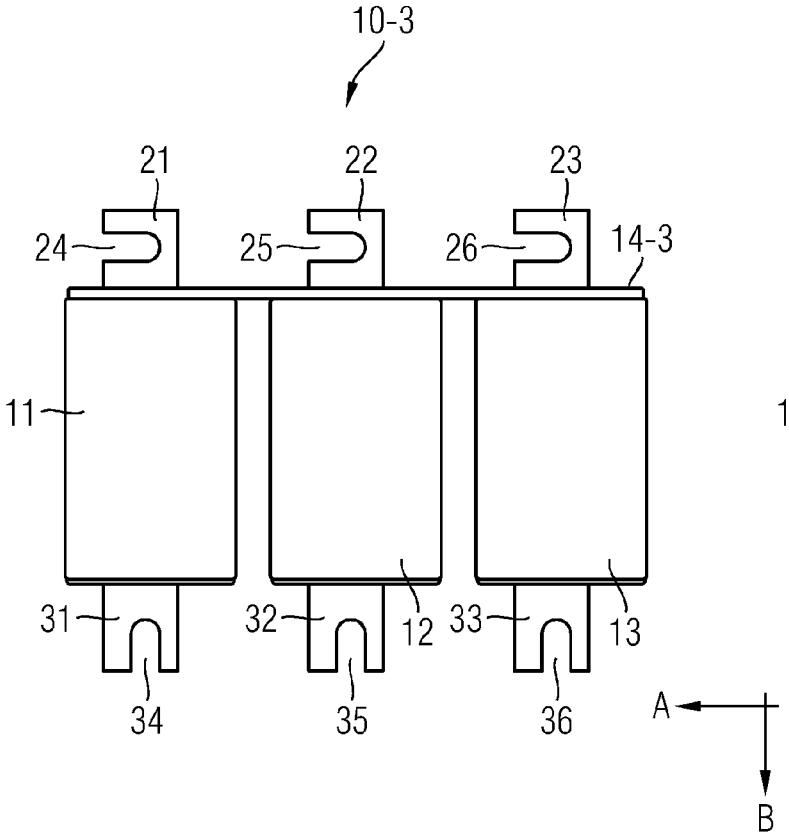
FIGS. 3A to 3C show schematic representations of a third exemplary embodiment of the fuse arrangement.
Figure 3B:
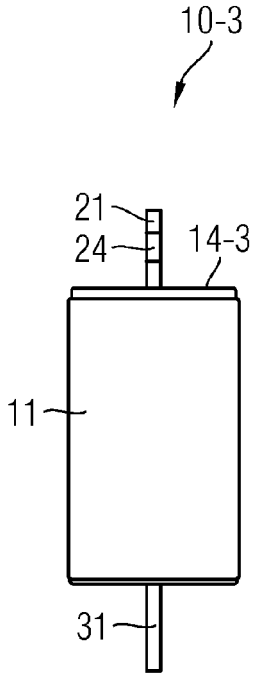
Figure 3C:
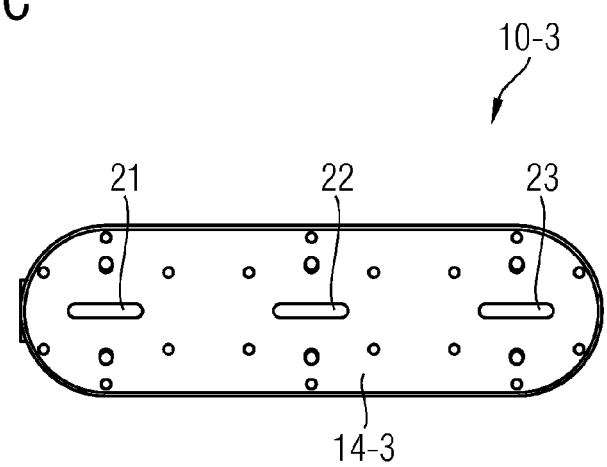
Figure 4A:
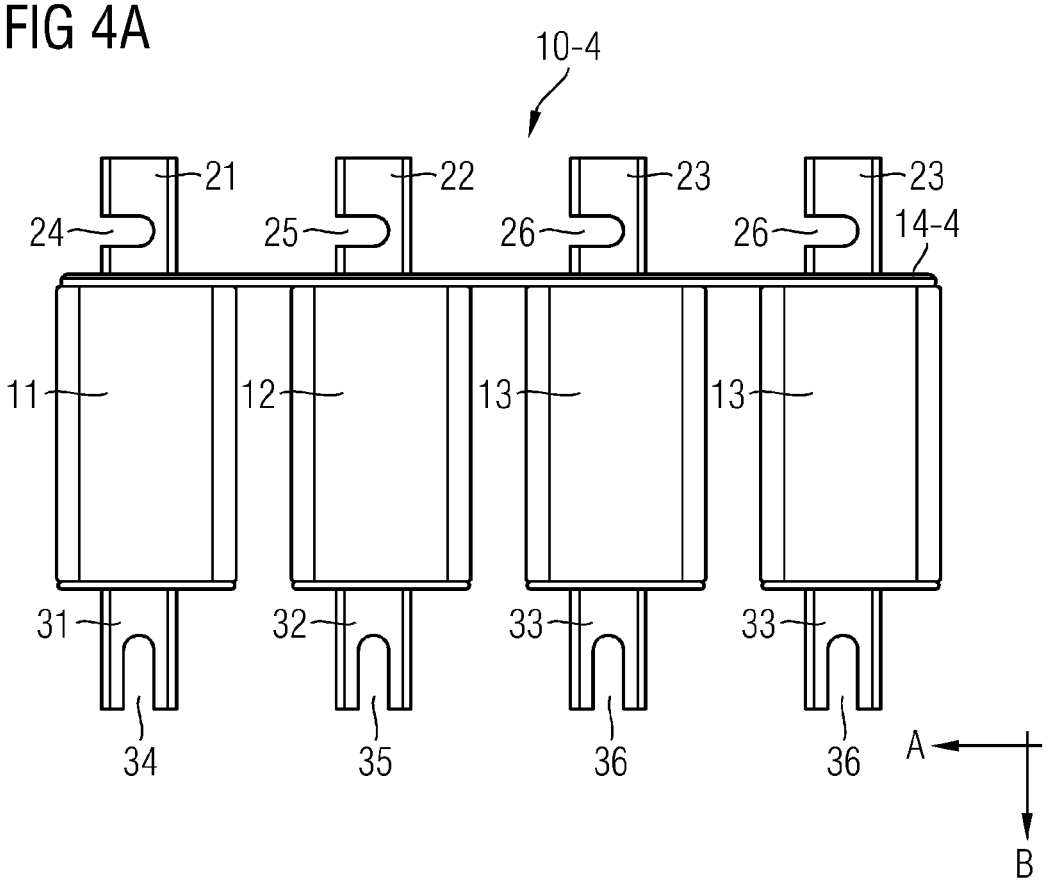
FIGS. 4A to 4D show schematic representations of a fourth exemplary embodiment of the fuse arrangement.
Figure 4B:
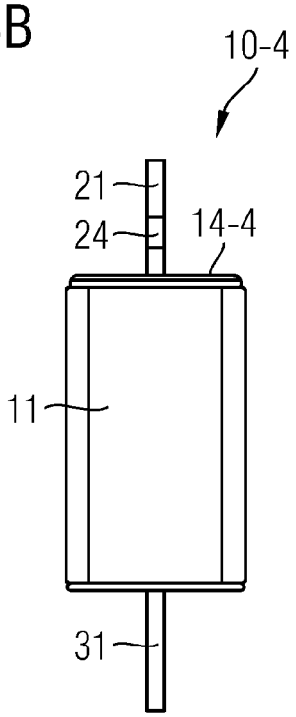
Figure 4C:
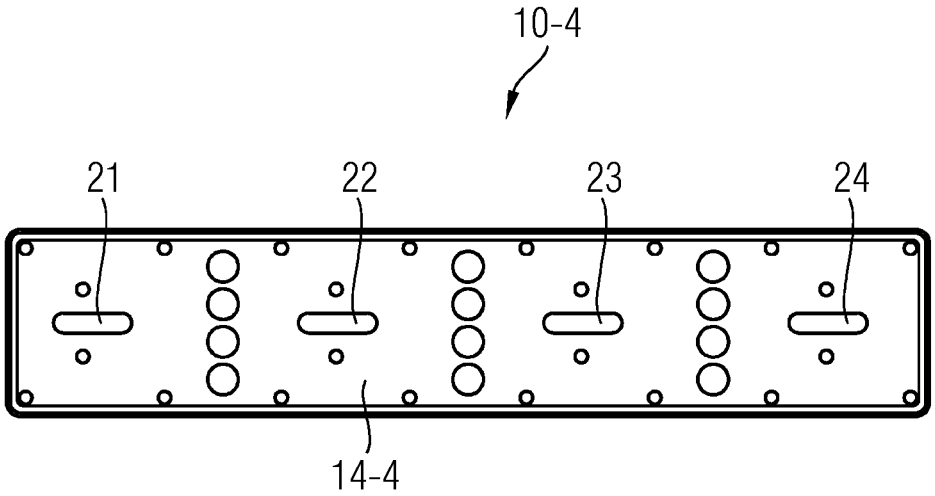
Figure 4D:
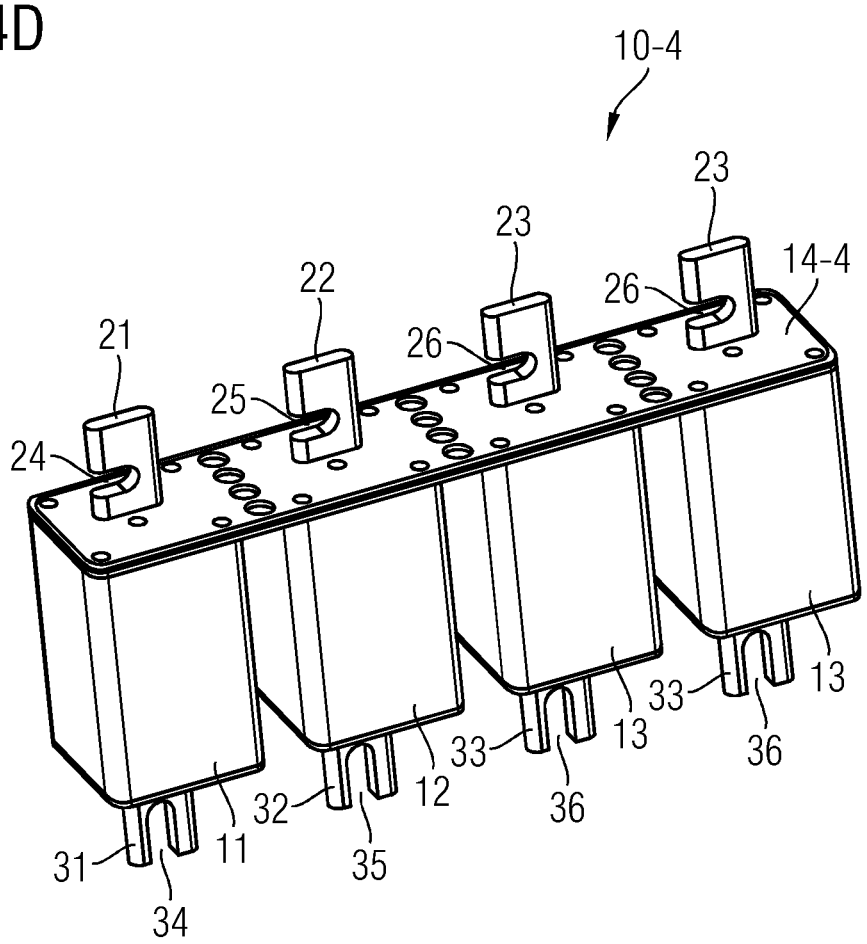

A third exemplary embodiment of the fuse arrangement 10-3 is shown schematically in several views in FIGS. 3A to 3C. Here, aside from the first safety fuse 11 and the second safety fuse 12, a further safety fuse 13 is in turn mechanically coupled to a correspondingly embodied end plate 14-3, such as also already shown in the second exemplary embodiment in FIGS. 2A to 2D. Contrary to this, the safety fuses 11, 12 and 13 nevertheless comprise a cylindrical safety body. The end plate 14-3 assumes this shape and is therefore embodied to be correspondingly rounded in its border areas. This arrangement otherwise corresponds to the fuse arrangement 10-2 shown in FIGS. 2A to 2D.

In FIGS. 4A to 4D, a fourth exemplary embodiment of the fuse arrangement 10-4 is shown schematically in several views. Here four square safety fuses—the first safety fuse 11, the second safety fuse 12 and two further safety fuses 13—are combined to form a structural unit by means of a correspondingly embodied end plate 14-4. The current flow is in this way split into four safety fuses. Otherwise this arrangement corresponds to the fuse arrangements 10-1 or 1-2 shown in FIGS. 1A to 1D and 2A to 2D.

FIG. 5 shows an example circuit 40 including a power source 42 and a busbar 50 including a pair of blade contact receptacles 52 for receiving blades 21 and 22 of example fuse arrangement 10-1.

LIST OF REFERENCE CHARACTERS

10 fuse arrangement
11 first safety fuse
12 second safety fuse
13 further safety fuse
14 end plate
21 first contact
22 first contact
23 first contact
24 first slot
25 first slot
26 first slot
31 second contact
32 second contact
33 second contact
34 second slot
35 second slot
36 second slot
40 circuit
42 power source
50 busbar
52 blade receptacles
A first direction
5B longitudinal direction

What is claimed is:

1. A fuse arrangement, comprising:

a first safety fuse having a first contact at a first end of the first safety fuse and a second contact at an opposite second end of the first safety fuse, a second safety fuse arranged adjacent to the first safety fuse and having a first contact at a first end of the second safety fuse and a second contact at an opposite second end of the second safety fuse, the first and second safety fuses being arranged for an electrically parallel connection, wherein each safety fuse comprises a first contact and a second contact, wherein each first contact comprises a blade contact such that the fuse arrangement includes a pair of first blade contacts configured and arranged relative to each other for insertion into a respective pair of blade contact receptacles of a busbar, and a conductive or non-conductive end plate mechanically permanently connected to the first end of the first safety fuse and the first end of the second safety fuse to form a permanent structural unit, such that the first safety fuse cannot be individually removed from the permanent structural unit, whereby the structural unit prevents independent insertion of one of the first blade contacts into one of the blade contact receptacles of the busbar without simultaneous insertion of the other first blade contact into the other blade contact receptacle of the busbar, and prevents independent removal of one of the first blade contacts from one of the blade contact receptacles of the busbar without simultaneous removal of the other first blade contact from the other blade contact receptacle of the busbar, and wherein the respective first contacts of the first and second fuses, and the respective second contacts of the first and second fuses, are electrically connected to a circuit including a current source, and wherein the respective first ends of the first and second safety fuses are mechanically connected to each other by the end plate, and the respective seconds ends of the first and second safety fuses are mechanically disconnected from each other.

2. The fuse arrangement of claim 1, comprising at least one further safety fuse arranged for an electrically parallel connection with the first safety fuse and the second safety fuse and undetachably connected to the end plate.

3. The fuse arrangement of claim 1, wherein the second contacts are embodied as blade contacts.

4. The fuse arrangement of claim 1, wherein at least one of the first blade contacts comprises slots.

5. The fuse arrangement of claim 3, wherein:

each first blade contact comprises a first slot aligned with a first direction, and each second blade contact comprises a second slot aligned along a longitudinal direction perpendicular to the first direction.

6. The fuse arrangement of claim 1, wherein the end plate comprises plastic.

7. A circuit comprising:

a current source, and a busbar, a fuse arrangement electrically coupled to the current source, the fuse arrangement comprising:

a first safety fuse, a second safety fuse arranged adjacent to the first safety fuse, wherein each of the first and second safety fuses comprises a first contact and a second contact, such that the fuse arrangement includes a pair of first contacts and a pair of second contacts, wherein the pair of first contacts are arranged adjacent each other and each connected to the busbar via a wire-free plug-type connection, and a conductive end plate directly and mechanically permanently connected to the first safety fuse and the second safety fuse to provide an electrically parallel connection between the first and second safety fuses and to form a structural unit, such that the first safety fuse cannot be individually removed from the permanent structural unit, whereby upon wire-free plug-type connection of the fuse arrangement to the busbar, the structural unit ensures that both of the first contacts are engaged simultaneously with corresponding connection structures of the busbar.

8. A fuse arrangement, comprising:

a first safety fuse having a first fuse body and a pair of first terminals, a second safety fuse arranged adjacent to the first safety fuse and having a second fuse body and a pair of second terminals, and a conductive end plate directly and permanently connected to the first safety fuse and the second safety fuse, with one first terminal of the first safety fuse and one second terminal of the second safety fuse extending beyond the conductive end plate in a direction away from the first and second fuse bodies, wherein the conductive end plate provides an electrically parallel connection between the first and second safety fuses and forms a structural unit with the first and second safety fuses, such that the first safety fuse cannot be individually removed from the permanent structural unit, whereby the structural unit prevents independent connection or disconnection of one of the first and second safety fuses with a busbar without simultaneous connection or disconnection of the other one of the first and second safety fuses with the busbar.

9. The fuse arrangement of claim 8, comprising at least one further safety fuse electrically connected in parallel to the first safety fuse and the second safety fuse and permanently connected to the end plate.

10. The fuse arrangement of claim 8, wherein each safety fuse comprises a first contact and a second contact.

11. The fuse arrangement of claim 10, wherein at least one of the first contact and the second contacts are embodied as blade contacts.

12. The fuse arrangement of claim 11, wherein at least one of the blade contacts comprises slots.

13. The fuse arrangement of claim 12, wherein:

each first contact comprises a first slot aligned with a first direction, and each second contact comprises a second slot aligned along a longitudinal direction perpendicular to the first direction.

* * * * *